US006253636B1

(12) United States Patent
Schmidt

(10) Patent No.: US 6,253,636 B1
(45) Date of Patent: Jul. 3, 2001

(54) FINGER LEVER SHAPED WITHOUT CUTTING

(75) Inventor: Dieter Schmidt, Nürnberg (DE)

(73) Assignee: INA Walzlager Schaeffler oHG (DE)

( * ) Notice: Subject to any disclaimer, the term of this patent is extended or adjusted under 35 U.S.C. 154(b) by 0 days.

(21) Appl. No.: 09/297,597

(22) PCT Filed: Jul. 2, 1997

(86) PCT No.: PCT/EP97/03479

§ 371 Date: Jun. 18, 1999

§ 102(e) Date: Jun. 18, 1999

(87) PCT Pub. No.: WO98/20235

PCT Pub. Date: May 14, 1998

(30) Foreign Application Priority Data

Nov. 7, 1996 (DE) ..... 196 45 788

(51) Int. Cl.[7] ..... F01L 1/18

(52) U.S. Cl. ..... 74/519; 74/559; 123/90.39

(58) Field of Search ..... 74/519, 559; 123/90.39, 123/90.41, 90.44

(56) References Cited

U.S. PATENT DOCUMENTS

| | | | | |
|---|---|---|---|---|
| 2,425,394 | | 8/1947 | Ronfeldt . | |
| 2,483,210 | * | 9/1949 | Leake | 74/519 |
| 2,490,262 | * | 12/1949 | Gable | 74/519 |
| 2,572,968 | * | 10/1951 | Bachle | 74/519 |
| 3,096,749 | * | 7/1963 | Davidson | 74/519 |
| 3,374,690 | * | 3/1968 | Hirose | 74/519 |
| 3,410,366 | * | 11/1968 | Winter, Jr. | 74/519 |
| 4,245,523 | * | 1/1981 | Wherry | 74/519 |
| 5,010,857 | | 4/1991 | Hempelmann et al. | 123/90.39 |
| 5,016,582 | | 5/1991 | Mills | 123/90.39 |
| 5,584,267 | * | 12/1996 | Muir | 123/90.39 |
| 5,671,707 | * | 9/1997 | Purcell et al. | 123/90.39 |
| 5,774,984 | * | 7/1998 | Kotani | 74/519 |

FOREIGN PATENT DOCUMENTS

| | | |
|---|---|---|
| 94 01 047 | 4/1994 | (DE) . |
| 63-272903 | 11/1988 | (JP) . |
| 7-259512 | 9/1995 | (JP) . |

OTHER PUBLICATIONS

Search Report from corresponding German Application 196 45 788.2 dated Apr. 9, 1997.

* cited by examiner

*Primary Examiner*—Thomas R. Hannon
*Assistant Examiner*—Chong H. Kim
(74) *Attorney, Agent, or Firm*—Volpe & Koenig PC

(57) ABSTRACT

A finger lever that is shaped without cutting having two side walls (5, 6), which are connected in a first end area (1) by a lower wall (4) in a U-shape which opens upwardly, is provided with a bearing surface for a gas exchange valve (11) that is formed by the side walls (5, 6) being adjacent to each other axially in the second end area (2) so that a separation plane (13) is formed in a longitudinal center plane (12) of the finger lever.

11 Claims, 4 Drawing Sheets

FINGER LEVER SHAPED WITHOUT CUTTING

FIELD OF THE INVENTION

The invention is directed to a finger lever that is shaped without cutting, comprising two side walls, which are connected in a first end area by a lower wall in a U-shape which open upwardly, the lower wall has a dome shaped recess which opens downwardly for receiving a support component, in a middle area the side walls are provided with two axially aligned drill holes in which a shaft that carries a cam roller is attached and a second end area is provided with a bearing surface for a gas exchange valve of an internal combustion engine.

BACKGROUND OF THE INVENTION

A finger lever of this general type is previously known from the U.S. Pat. No. 5,016,582. This finger lever that carries in its center a cam roller consists of two parallel running side walls, which are connected at one end by a lower wall. This lower wall is provided with a dome-shaped recess which rests on a support component. On the other end, the two side walls are in turn connected by a lower wall, which forms the bearing surface for a valve stem of a gas exchange valve of an internal combustion engine.

This has the disadvantage that the activation lever is constructed very wide in the area of the valve stem bearing and as a result also has a high mass.

SUMMARY OF THE INVENTION

The purpose of the invention is thus to develop a valve stem bearing surface, which takes up as small a construction space as possible.

According to the invention, this object is achieved according to the characterizing part of claim 1 in that the bearing surface is formed by the side walls being adjacent to each other axially in the second end area so that a separation plane is formed in a longitudinal center plane of the finger lever. In this way it is achieved that the finger lever is constructed to be especially small and thus low in mass.

According to claim 2, in the area of the separation plane, the side walls should be connected on their upper edge as a single piece with an upper edge of the outside walls, which run essentially parallel to the side walls adjacent to them and end below them. This special embodiment of the finger lever makes possible a larger degree of rigidity because of the doubled construction of the side walls in the second end area. Furthermore, a lateral guidance for the gas exchange valve is achieved by the overlapping progression of the outside wall over the side walls.

Based on a further characteristic of the invention according to claim 3, the side walls are connected at their lower edge as a single piece in the area of the separation plane to an upper edge of the outside walls, where the outside walls are located to the right and left spaced apart at a distance parallel to the side walls and end below them.

An additional embodiment of the finger lever is provided from claim 4. According to it, the side walls should be connected on their rear edge as a single piece with a rear edge of the outside walls, such that the outside walls in the area of the separation plane run essentially parallel to the side walls adjacent to them and end below them. Also, in this way, the rigidity described above and the bearing possibility for a valve stem can be created.

From the claims 5 and 6 it is provided that in the area of the separation plane, an accessory component functioning as a bearing surface is arranged, where this accessory component is made of a base plate and side walls extending downwardly from it, which themselves change into upwardly extending attachment walls. This accessory component makes possible an especially simple manufacture of the finger lever, since doublings of the side walls are not necessary.

Based on the additional characteristics according to claims 7 and 8, the side walls that are adjacent to each other and/or the side walls and outside walls that are adjacent to each other are affixed to each other, which can be done, for example, by a welding operation. By this affixing of the side walls to each other, the rigidity of the finger lever is further improved.

Finally, in the first end area of the finger lever according to claim 9, the connection of both side walls can also be done through a U-shaped upper wall that is open to the bottom.

The invention is described in greater detail in the following embodiment examples.

BRIEF DESCRIPTION OF THE DRAWINGS

Shown are.

DETAILED DESCRIPTION OF THE DRAWINGS

Figure 1:
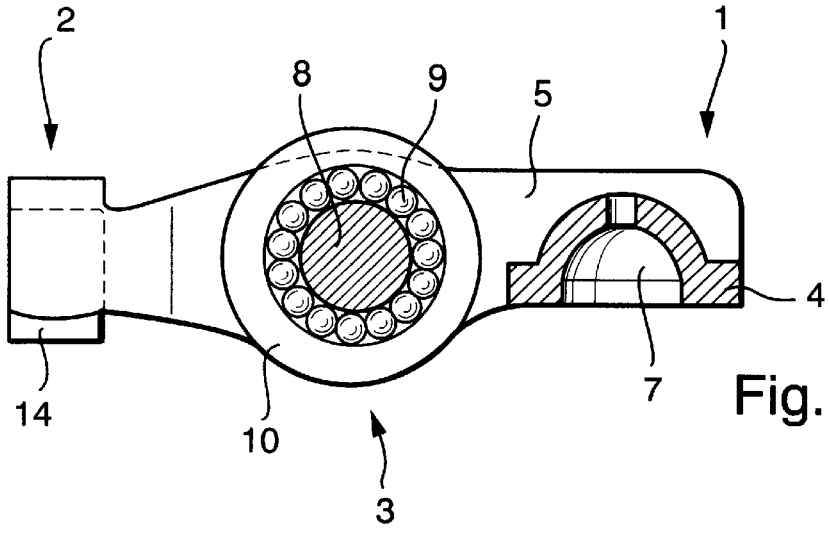
FIGS. 1, 4, 7, 10 a section along the line I—I, IV—IV, VII—VII, X—X in FIGS. 2, 5, 8, and 11, FIGS. 2, 5, 8, 11 an overhead view of a finger lever according to the invention from above and FIGS. 3, 6, 9, 12 a rear view of a finger lever in the direction of the cam roller.

The finger lever depicted in FIGS. 1 to 12 is manufactured by a forming operation without cutting from a piece of sheet metal and includes the two end areas 1, 2 as well as a center area 3. The end area 1 has a lower wall 4, from which over the entire longitudinal extension of the finger lever two side walls 5, 6 extend in an upwardly open U-shape. The lower wall 4 has a dome-shaped recess 7 that is constructed so that it is open downwardly and rests on a support component that is not shown. In the center area 3, a cam roller 10 is rotatably supported so that it can rotate on a shaft 8 via a needle bearing 9 and it is impinged by a cam that is not shown. In the end area 2, a gas exchange valve 11 is arranged which opens during a pivot movement of the finger lever, which is triggered by the cam. In this area 2, the bearing surface for the gas exchange valve 11 is formed through the side walls 5, 6 that are axially adjacent to each other, so that in a longitudinal center plane 12 of the finger lever, a separation plane 13 is formed, i.e. the separation plane 13 is a part of the longitudinal center plane 12.

Figure 2:
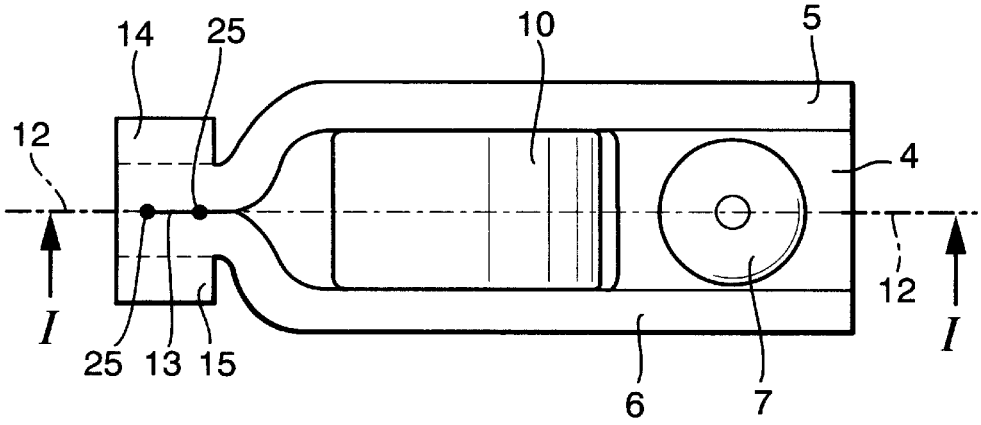
Figure 3:
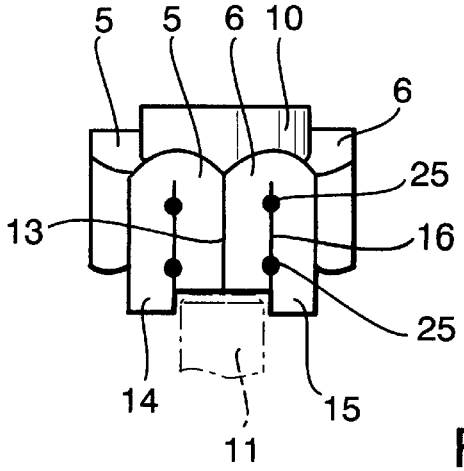

In the area of the separation plane 13, according to FIGS. 1 to 3, the side walls 5, 6 are connected at their upper edge as a single piece with the upper edge of the outside walls 14, 15. These outside walls 14, 15 extend downwardly and are adjacent to the side walls 5, 6, i.e. they run parallel to them and end below the side walls 5, 6. In this way, a recess consisting of side walls 5, 6 and outside walls 14, 15 is formed, which in the lateral direction, makes possible a guide for the gas exchange valve 11. In order to increase the rigidity of the finger lever, the side walls 5, 6 in the separation plane 13 are affixed to each other, i.e. connected together, and the side walls 5, 6 are affixed to the outside walls 14, 15 in the separation plane 16. This can be done, for example, through spot-welds 25.

Figure 4:
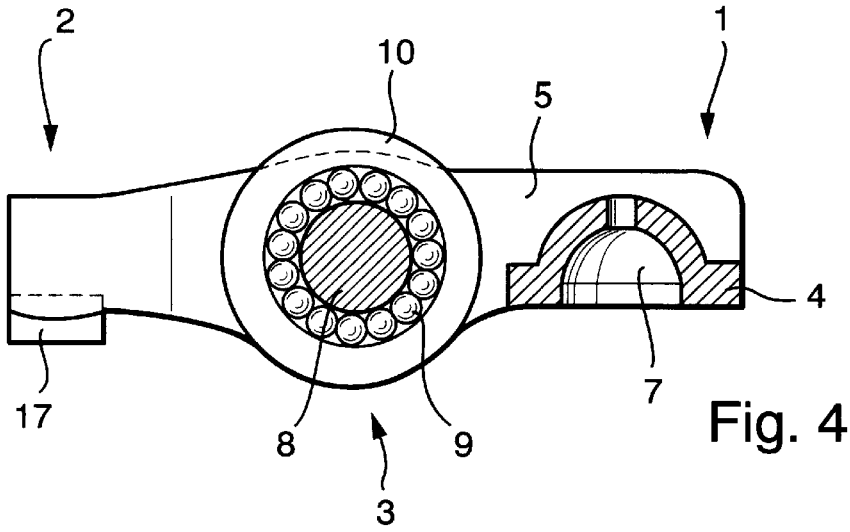
Figure 5:
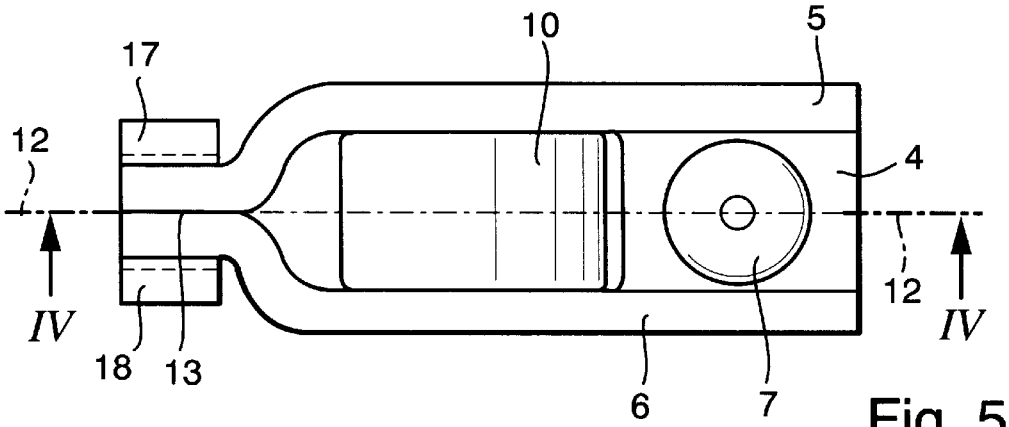
Figure 6:
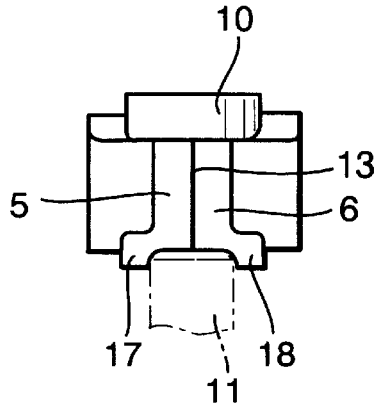

In the end area 2 of the finger lever depicted in FIGS. 4 to 6, the bearing surface for the gas exchange valve 11 is formed through the two side walls 5, 6 lying adjacent to the separation plane 13. For the lateral guidance of the gas exchange valve 11, the side walls 5, 6 are connected at their lower edge as a single piece with an upper edge of the outside walls 17, 18, where the outside walls 17, 18 are spaced apart at a distance to the right and left and parallel to the side walls 5, 6 and end beneath them. Also, here in order to improve the rigidity, the two side walls 5, 6 are connected in the separation plane 13 by being welded together.

Figure 7:
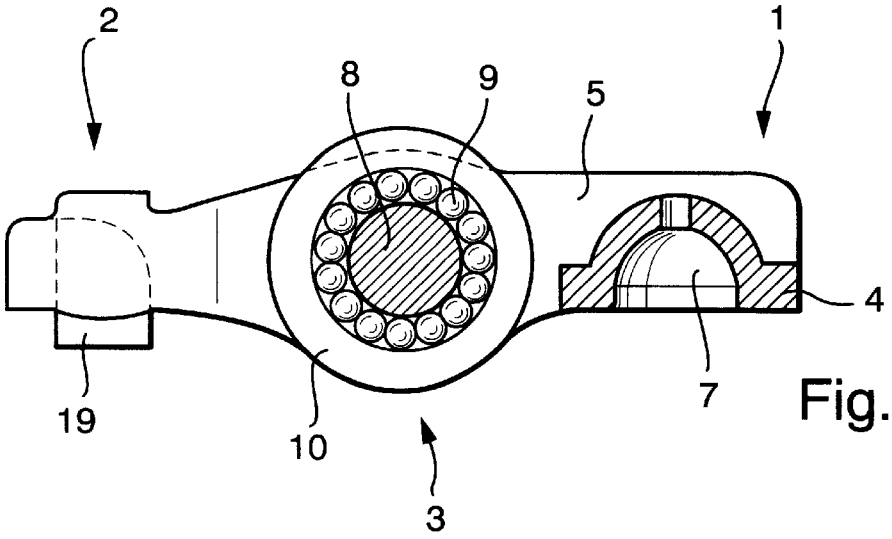
Figure 8:
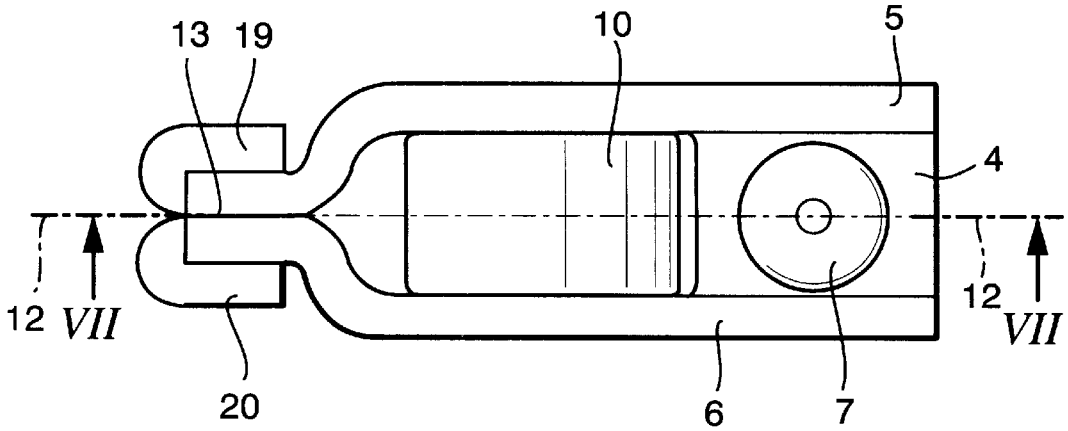
Figure 9:
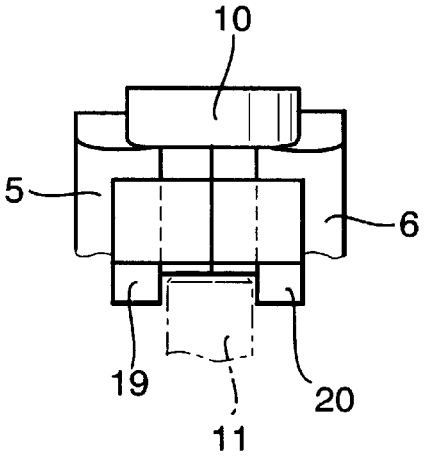

In the finger lever depicted in FIGS. 7 to 9, the side walls 5, 6 are connected at their rear edge to a rear edge of the outside walls 19, 20, where in this case the outside walls 19, 20 extend in the area of the separation plane 13 in the direction of the cam roller 10. They in turn end beneath the side walls 5, 6 so that a lateral bearing surface for the gas exchange valve 11 results.

Figure 10:
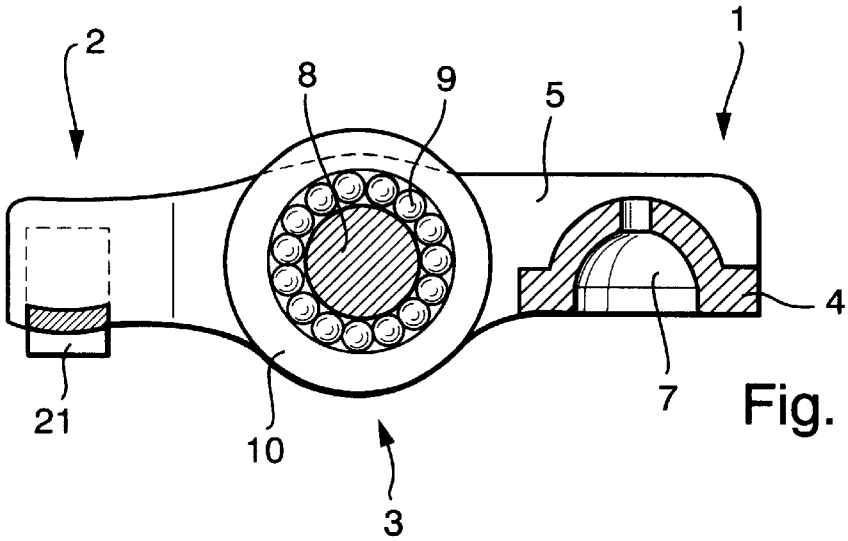
Figure 11:
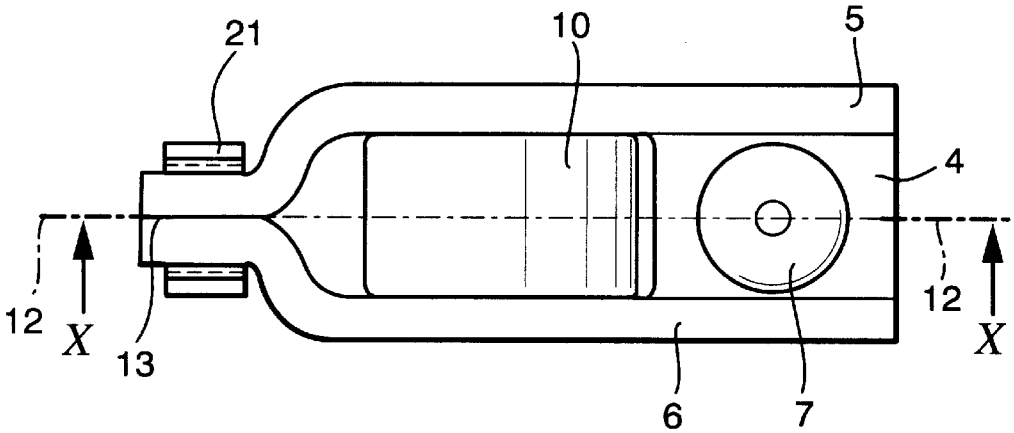
Figure 12:
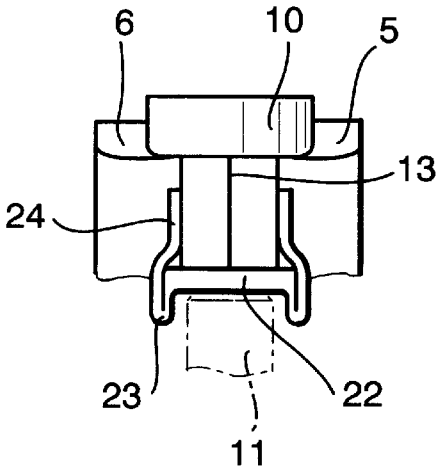

The finger lever depicted in FIGS. 10 to 12 appears to be especially advantageous. There, in the area of the separation plane 13, on the side walls 5, 6 adjacent to each other, an accessory component 21 functioning as a bearing surface for the gas exchange valve 11 is plugged in. This accessory component 21 consists of a base plate 22 having downwardly extending side walls 23, which transition into upwardly extending attachment walls 24.

List of Reference Numbers

| | | | |
|---|---|---|---|
| 1 | End area | 13 | Separation plane |
| 2 | End area | 14 | Outside wall |
| 3 | Center area | 15 | Outside wall |
| 4 | Lower wall | 16 | Separation plane |
| 5 | Side wall | 17 | Outside wall |
| 6 | Side wall | 18 | Outside wall |
| 7 | Dome-shaped recess | 19 | Outside wall |
| 8 | Shaft | 20 | Outside wall |
| 9 | Needle collar bearing | 21 | Accessory component |
| 10 | Cam roller | 22 | Base plate |
| 11 | Gas exchange valve | 23 | Side wall |
| 12 | Longitudinal center plane | 24 | Attachment wall |
| | | 25 | Welding position |

What is claimed is:

1. Finger lever that is shaped without cutting, comprising two side walls (5, 6), which are connected in a first end area (1) by a lower wall (4), in a U-shape that is open upwardly, the lower wall (4) has a recess (7) in a downwardly open dome shape for receiving a support component, in a middle area (3) the side walls (5, 6) are provided with two axially aligned holes in which a shaft (8) that carries a cam roller (10) is attached and a second end area (2) is provided with a bearing surface for a gas exchange valve (11) of an internal combustion engine, the bearing surface is formed by the side walls (5, 6) being adjacent to each other axially in the second end area (2) so that an intersection between the side walls (5, 6) defines a separation plane (13) along a longitudinal center plane (12) of the finger lever, the side walls (5, 6) are each connected on at least one of an upper, rear and lower edge as a single piece with an edge of a respective outside wall (14, 15), the outside walls extend generally parallel and adjacent to the side walls (5, 6) and end below a lower edge of the side walls in the second end area.

2. Finger lever that is shaped without cutting according to claim 1, wherein in an area of the separation plane (13), the side walls (5, 6) are each connected on the upper edge as a single piece with an upper edge of a respective outside wall (14, 15).

3. Finger lever that is shaped without cutting according to claim 1, wherein in an area of the separation plane (13), the side walls (5, 6) are each connected at the lower edge as a single piece to an upper edge of a respective outside wall (17, 18).

4. Finger lever that is shaped without cutting according to claim 1, wherein the side walls (5, 6) are connected on a rear edge as a single piece with the rear edge of outside walls (19, 20).

5. Finger lever that is shaped without cutting according to claim 1, wherein at the second end area (2) where the side walls lie axially against one another, an accessory component (21) functioning as a bearing surface is arranged.

6. Finger lever that is shaped without cutting according to claim 5, wherein the accessory component (21) is made of a base plate (22) having downwardly extending side walls (23), which transition into upwardly extending attachment walls (24).

7. Finger lever that is shaped without cutting according to claim 1, wherein the side walls (5, 6) that are adjacent to each other are affixed to each other.

8. Finger lever that is shaped without cutting according to claim 7, wherein the walls (5, 6, 14, 15, 19, 20) are connected to each other by a welding operation.

9. Finger lever that is shaped without cutting, comprising two side walls (5, 6), which are connected in a first end area (1) by an upper wall (4), in a U-shape that is open downwardly, the upper wall (4) has a recess (7) in a downwardly open dome shape for receiving a support component, in a middle area (3) the side walls (5, 6) are provided with two axially aligned holes in which a shaft (8) that carries a can roller (10) is attached and a second end area (2) is provided with a bearing surface for a gas exchange valve (11) of an internal combustion engine, the bearing surface is formed by the side walls (5, 6) being adjacent to each other axially in the second end area (2) so that the intersection between the side walls (5, 6) defines a separation plane (13) in a longitudinal center plane (12) of the finger lever, the side walls (5, 6) are each connected on at least one of an upper, rear and lower edge as a single piece with an edge of a respective outside wall (14, 15), the outside walls extend generally parallel and adjacent to the side walls (5, 6) and end below a lower edge of the side walls in the second end area.

10. Finger lever that is shaped without cutting according to claim 2, wherein the side walls (5, 6) that are adjacent to each other are affixed to each other and the side walls (5, 6) and outside walls (14, 15) that are adjacent to each other are affixed to each other.

11. Finger lever that is shaped without cutting according to claim 4, wherein the side walls (5, 6) that are adjacent to each other are affixed to each other and the side walls (5, 6) and outside walls (19, 20) that are adjacent to each other are affixed to each other.

* * * * *